US008687987B2

(12) United States Patent
Yano et al.

(10) Patent No.: US 8,687,987 B2
(45) Date of Patent: Apr. 1, 2014

(54) IMAGE FORMING APPARATUS

(75) Inventors: Kouki Yano, Kawasaki (JP); Takuya Kitamura, Yokohama (JP); Hideo Kihara, Yokohama (JP); Yuta Isobe, Kawasaki (JP); Yuji Kawaguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 13/484,726

(22) Filed: May 31, 2012

(65) Prior Publication Data

US 2012/0308247 A1 Dec. 6, 2012

(30) Foreign Application Priority Data

Jun. 2, 2011 (JP) ..... 2011-124318

(51) Int. Cl.
*G03G 15/08* (2006.01)

(52) U.S. Cl.
USPC ..... 399/53

(58) Field of Classification Search
USPC ..... 399/27, 55, 61–63, 81, 99, 265
See application file for complete search history.

(56) References Cited

U.S. PATENT DOCUMENTS

| | | | | |
|---|---|---|---|---|
| 7,991,315 | B2 * | 8/2011 | Kawamura et al. | 399/61 |
| 8,155,539 | B2 | 4/2012 | Kawasaki et al. | |
| 8,478,140 | B2 * | 7/2013 | Hirata | 399/27 |
| 2009/0003884 | A1 | 1/2009 | Kawamura et al. | |

FOREIGN PATENT DOCUMENTS

| | | | |
|---|---|---|---|
| JP | 2009-9035 | A | 1/2009 |

* cited by examiner

*Primary Examiner* — Hoang Ngo
(74) *Attorney, Agent, or Firm* — Fitzpatrick, Cella, Harper & Scinto

(57) ABSTRACT

An image forming apparatus includes an image bearing member; developing devices, each of which includes a developer carrying member, having an electrode member, for carrying a developer, and a developer feeding member, having a core metal and a surface foam layer, for supplying the developer to the developer carrying member; a supporting member, supporting the developing devices, for sequentially rotating the developing devices to a developing position; and a controller for executing an operation for reducing non-uniform distributions of the developers in the developing devices on the basis of electrostatic capacities between the electrode members and the core metals, respectively.

10 Claims, 6 Drawing Sheets

IMAGE FORMING APPARATUS

FIELD OF THE INVENTION AND RELATED ART

The present invention relates to an image forming apparatus including a plurality of developing devices held by a supporting member.

A full-color image forming apparatus comprising a single image bearing member, and a rotatable supporting member carrying a plurality of developing devices, wherein the developing devices are switched sequentially at predetermined timing to develop an electrostatic latent image formed on a surface of the image bearing member.

As for a method for detecting a remaining amount of the toner in the developing device for the image forming apparatus, there is known an electrostatic capacity detecting type system which obtains information relating to the developer remainder by detecting an electrostatic capacity between the two inter-electrodes provided in the developing device.

In a developing device comprising a developing roller as a toner carrying member and a supplying roller having a foam layer as a toner supplying member, an electrostatic capacity between a core metal of the developing roller and a core metal of the supplying roller is detected to obtain the information relating to the remaining toner amount (Japanese Laid-open Patent Application 2009-9035, for example).

Generally, the developing roller and the supplying roller are placed in a developing chamber in the developing device, and before the initial use of the device, the developer is in the same region as these rollers, or is in a developer chamber separated from the developing chamber by a toner seal.

With an image forming apparatus which can be transported in the state that the developing devices are mounted on the rotatable supporting member, too much toner is on one side (non-uniform distribution) in the developing devices depending on the orientation of attitude of the apparatus during the transportation.

In the case of the developing device having the toner seal in the unused state, a user once takes the device out of the main assembly of the apparatus, and pulls out the toner seal. At this time, the non-uniform distribution of the toner can be corrected.

SUMMARY OF THE INVENTION

In a developing device not having a toner seal, however, the toner seal pulling operation is unnecessary, and therefore, the toner seal pulling operation cannot be expected for the correction of the non-uniform distribution of the toner. In such a case, if the apparatus is operated with the state of the non-uniform distribution of the toner, an image having white void may result in the initial stage after the installation.

Accordingly, it is a principal object of the present invention to provide an apparatus with which the non-uniform distribution of the toner is reduced at the time of initial installation.

According to an aspect of the present invention, there is provided an image forming apparatus comprising an image bearing member for carrying an electrostatic latent image; a plurality of developing devices, each of which includes a developer carrying member, having an electrode member, for carrying a developer and for developing the electrostatic latent image, and a developer feeding member, having a core metal and a surface foam layer, for supplying the developer to said developer carrying member; a supporting member, supporting the developing devices, for sequentially rotating said developing devices to a developing position where the electrostatic latent image is developed; and a controller for executing an operation for reducing non-uniform distributions of the developers in longitudinal directions of said developer feeding members in said developing devices on the basis of electrostatic capacities between said electrode members and said core metals in said developing devices, respectively.

According to the structure, the non-uniform distribution of the toner can be reduced at the time of initial installation.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated. Therefore, the present invention is not limited to the specific examples which will be described (Structure of Image Forming Apparatus)

Figure 1:
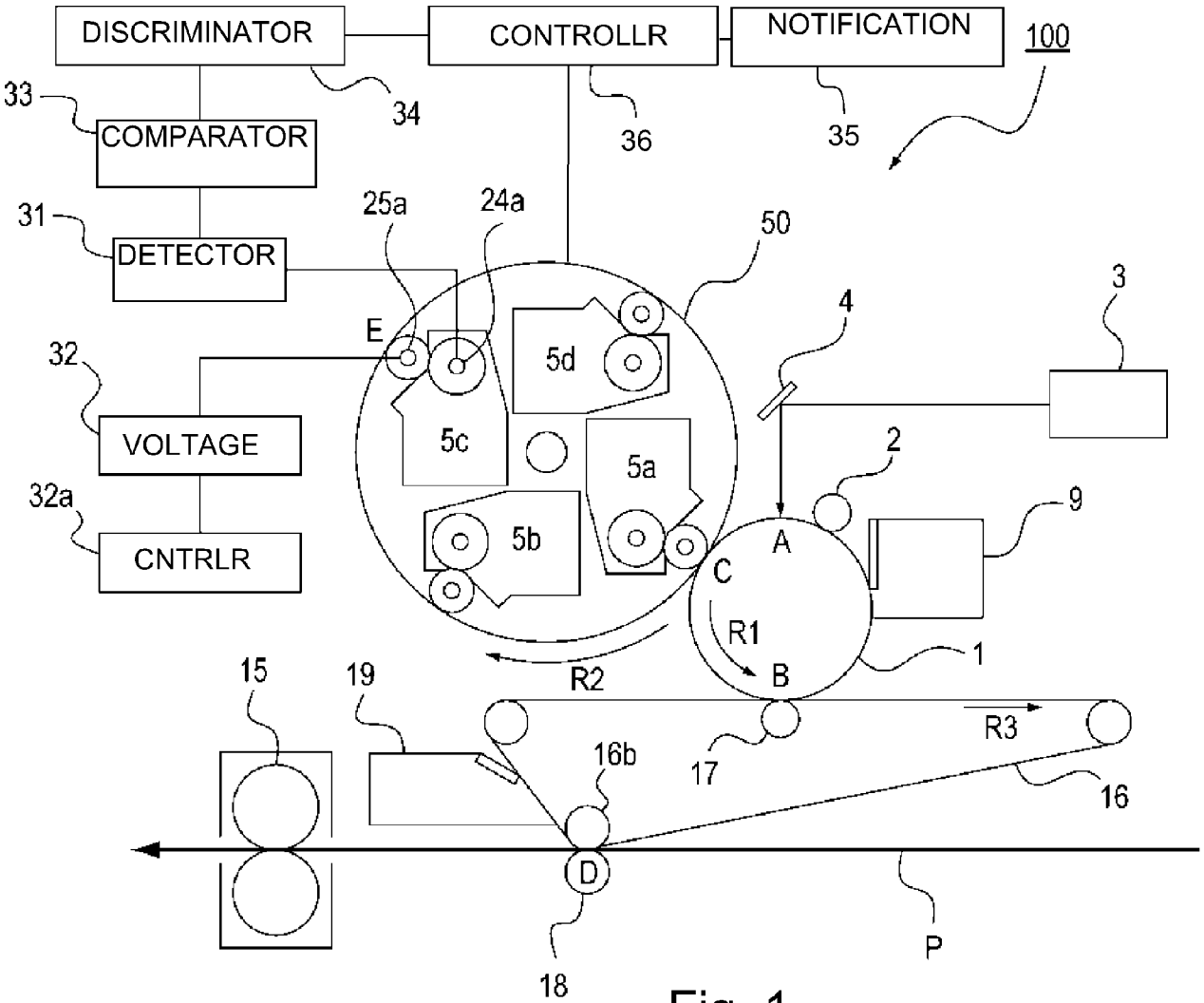
FIG. 1 is a schematic illustration of an image forming apparatus according to an embodiment of the present invention.

FIG. 1 is a schematic illustration of an image forming apparatus according to this embodiment of the present invention. As shown in FIG. 1, the image forming apparatus 100 comprises a photosensitive drum 1 as an image bearing member. The photosensitive drum 1 rotates in a direction of an arrow R1 Around the photosensitive drum 1, there are provided a charging roller 2 and an exposure device 3. A laser beam is outputted from the exposure device 3 and reaches the exposure position above photosensitive drum 1 through a reflection mirror 4. Then, an electrostatic latent image is formed on the photosensitive drum 1.

Opposed to the photosensitive drum 1, there is provided a rotary drum 50 provided with developing devices 5 (5*a*, 5*b*, 5*c*, 5*d*) as four developing means. The developing devices 5 (5*a*, 5*b*, 5*c*, 5*d*) contain developers including yellow toner, magenta toner, cyan toner and black toner, respectively. Inside structures of the developing devices 5 are the same, and therefore, in the following description, the suffixes a-d of the reference numerals are omitted, when it is unnecessary to refer to a particular color.

All the developing devices 5 are mountable to the rotary drum 50 as the supporting member. The rotary drum 50 is supported rotatably in the state of carrying the developing devices 5, and places a necessary developing device (yellow developing device 5*a*, for example, in FIG. 1) so as to oppose to the photosensitive drum 1 (developing position C). The rotary drum 50 is driven and controlled by a controller.

Below the photosensitive drum 1, an intermediary transfer belt 16 as an intermediary transfer member is provided. The intermediary transfer belt 16 is stretched around a plurality of rollers and is rotated in the direction of R3 in FIG. 1. In a primary transfer position B where the intermediary transfer belt 16 is press-contacted to the photosensitive drum 1, the intermediary transfer belt 16 is sandwiched between a primary transfer roller 17 and the photosensitive drum 1.

One of stretching rollers stretching the intermediary transfer belt 16 is a secondary transfer opposing roller 16*b*, opposite which a secondary transfer roller 18 is disposed through the intermediary transfer belt 16. The secondary transfer roller 18 is capable of moving to and away from the intermediary transfer belt 16. The position where the secondary transfer roller 18 moves is a secondary transfer position D. In the secondary transfer position D, as will be described hereinafter, an image is secondary transferred onto a transfer material P fed thereto. The transfer material P after the secondary transfer is fed to a fixing device 15.

A cleaning device 19 is provided at a position downstream of the secondary transfer position D with respect to a moving direction of the intermediary transfer belt 16. The cleaning device 19 is provided with a blade contacted to the intermediary transfer belt 16 to scrape the toner off the intermediary transfer belt 16. Similarly, for the photosensitive drum 1, a photosensitive member cleaning device 9 is provided with at a position downstream of the primary transfer position B with respect to the moving direction of the photosensitive drum 1, and the photosensitive member cleaning device 9 is provided with a blade for scraping the toner off the photosensitive drum 1. With such a structure, the untransferred toner is removed.

(Image Forming Operation)

An image forming operation of the image forming apparatus 100 will be described.

As shown in FIG. 1, the photosensitive drum 1 is rotated in the direction of the arrow R1, during which the surface of the photosensitive drum 1 is charged to a predetermined potential by the charging roller 2. In the exposure position A, the photosensitive drum 1 is exposed to the laser beam in accordance with image signal for each color by the exposure device 3 and the reflection mirror 4. By the exposure the electrostatic latent image is formed on the photosensitive drum 1.

The electrostatic latent image formed on the photosensitive drum 1 is developed in the developing position C by the developing device 5 into a toner image. Particular one of the developing devices 5 provided in the developing position C corresponding to the color of the image signal is brought to the developing position C by the rotation of the rotary drum 50 in the direction of an arrow R2. The order of the colors of the developments is yellow, magenta, cyan and black in this embodiment.

The toner image formed on the photosensitive drum 1 is transferred onto the intermediary transfer belt 16 in the primary transfer position B. The toner images are transferred sequentially superimposingly so that a full-color toner image is formed on the intermediary transfer belt 16.

The secondary transfer roller 18 is spaced from the intermediary transfer belt 16 until the full-color toner image is formed, and is contacted to the intermediary transfer belt 16 after the full-color toner image is formed. The transfer material P is fed in timed relation with arrival of the formed full-color toner image at the secondary transfer position D.

The secondary transfer roller 18 and the secondary transfer opposing roller 16*b* cooperate with each other to nip the transfer material P and the intermediary transfer belt 16 to secondary-transfer the full-color toner image onto the transfer material P. The transfer material P carrying the transferred full-color toner image is fed to the fixing device 15.

The fixing device 15 presses and heats the full-color toner image on the transfer material P to fix the full-color toner image (final image) on the transfer material P.

(Detailed Structure of Developing Device)

Figure 2:
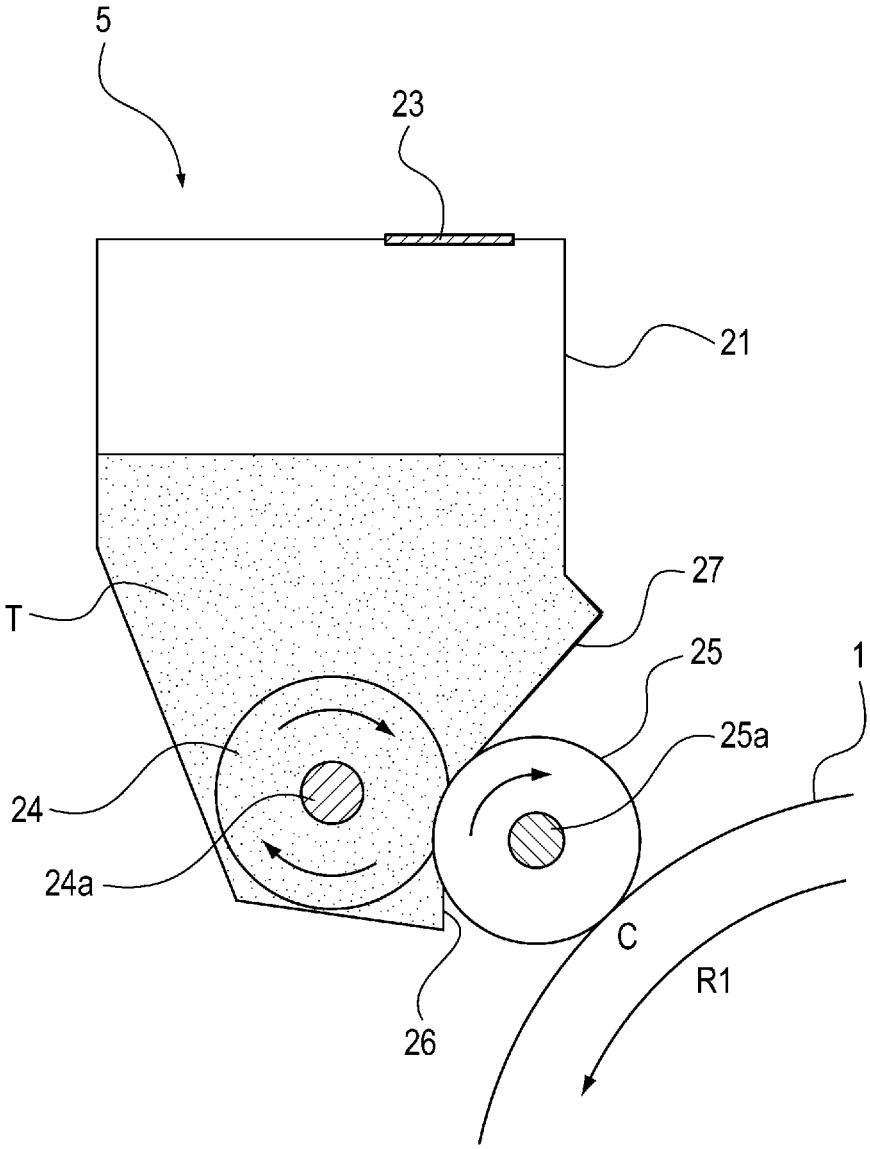
FIG. 2 is an illustration of the developing device in an image forming operation in this embodiment.

Referring to FIG. 2, the developing device 5 will be described in detail. FIG. 2 is an illustration of the developing device during image forming operation. In FIG. 2, the peripheral structures such as the rotary drum 50 are omitted.

In the developing device 5, the toner is accommodated in a developing container 21. The developing container 21 is disposed in a lower opening and includes a developing roller 25 a developer carrying member opposing the photosensitive drum 1. In a position adjacent the developing roller 25 in the lower part inside the developing container 21, a supplying roller 24 a developer feeding member is provided. An amount of the toner on the supplying roller 24 is regulated by a regulating blade 27 as a developer regulating member. The supplying roller 24 includes an electroconductive core metal 24*a* as a first electrode member, and the developing roller 25 includes an electroconductive core metal as a second electrode member. A preventing seal 26 is provided to cover a gap between the developing roller 25 and the developing container 21.

The supplying roller 24 comprises an electroconductive core metal 24*a* having a diameter ϕ6 (mm), and a foam layer of urethane sponge layer or the like on the electroconductive core metal 24*a*. The urethane sponge layer of this embodiment is a surface foam soft layer including continuous pores. An outer diameter of the supplying roller 24 is ϕ15 (mm), and the volume resistivity thereof is approx. 10ˆ8 Ωcm. The surface of the urethane sponge layer has a flow rate of 3.2 liter/min.

The developing roller 25 includes an electroconductive core metal 25*a* having a diameter of ϕ8 (mm). Around the electroconductive core metal 25*a*, an electroconductive elastic layer comprising silicone rubber is formed. A surface layer of the developing roller 25 is a rubber layer of acrylic or urethane main assembly. An outer diameter of the developing roller 25 is ϕ13 (mm), and a volume resistivity is approx. 10ˆ5 Ωcm.

In order to detect an electrostatic capacity which will be described hereinafter, the developing roller 25 may be provided with a second electrode member, and the second electrode member may be an electroconductive sleeve which may be provided around the surface of the developing roller 25, for example.

In this embodiment, a distance (center-to-center distance) between a center of the electroconductive core metal 25*a* of the developing roller 25 and a center of the electroconductive core metal 24*a* of the supplying roller 24 is 13 mm. The surface of the developing roller 25 bites into the urethane sponge layer of the supplying roller 24 by 1.0 mm. The depth of 1.0 mm is a difference between the center-to-center distance and one half of a sum of the outer diameters of the supplying roller 24 and the developing roller 25 on the line connecting the center of the electroconductive core metal 25*a* and the center of the electroconductive core metal.

The regulating blade 27 comprises a flexible phosphor bronze metal plate, and one end portion thereof is fixed to the developing container 21, and the other end portion which is a free end is contacted to the developing roller 25. The free end of the regulating blade 27 is counter-directional relative to a rotational moving direction of the developing roller 25, a smooth surface thereof neighborhood of the free end slides on the surface of the developing roller 25.

(Electrostatic Capacity Measuring Method)

The description will be made as to an electrostatic capacity measuring method for execution of a detecting sequence for detecting the non-uniform distribution (offset) of the toner.

As shown in FIG. 1, in order to measure the electrostatic capacity, a voltage applying means 32 for the detection is connected with the electroconductive core metal 25*a*, and a detection circuit 31 as an electrostatic capacity detecting means is connected with the electroconductive core metal 24*a*. In addition, there are provided a comparator 33 as comparing means for comparing the electrostatic capacity detected by the detection circuit 31 with a threshold which will be described hereinafter, and a discriminating means 34 (detection portion) for discriminating whether or not the non-uniform distribution of the toner has occurred. The result of the discrimination of the discriminating means 34 is notified by notification means 35. A controller 36 receives the discrimination result of the discriminating means 34 and controls a notification signal for notifying the user by the notification means 35. The voltage applying means 32 is connected with the voltage control means 32*a* for controlling the voltage.

An AC bias voltage for the electrostatic capacity detection has a frequency of 50 kHz and a peak-to-peak voltage Vpp=200V. In measuring the electrostatic capacity, a predetermined AC bias voltage is applied to the electroconductive core metal 25*a* of the developing roller 25, by which an AC voltage is induced in the electroconductive core metal 24*a* of the supplying roller 24, and an electrostatic capacity between the core metals is detected from the induced AC voltage.

It will suffice if one of the electroconductive core metal 25*a* and the electroconductive core metal 24*a* is supplied with an AC bias voltage, and the output of the other is detected. Therefore, it is a possible alternative that the AC bias is applied to the electroconductive core metal 24*a*, and the remaining toner amount measurement is effected from the AC voltage induced in the electroconductive core metal 25*a*.

The AC voltage induced in the electroconductive core metal 24*a* is rectified by the detection circuit 31. The rectified DC voltage per set or information of a signal of a digitized DC voltage is outputted. The output value is indicative of an electrostatic capacity between the electroconductive core metal 25*a* and the electroconductive core metal, and the electrostatic capacity reflects a toner amount existing between the electroconductive core metal 25*a* and the electroconductive core metal 24*a*.

Figure 3:
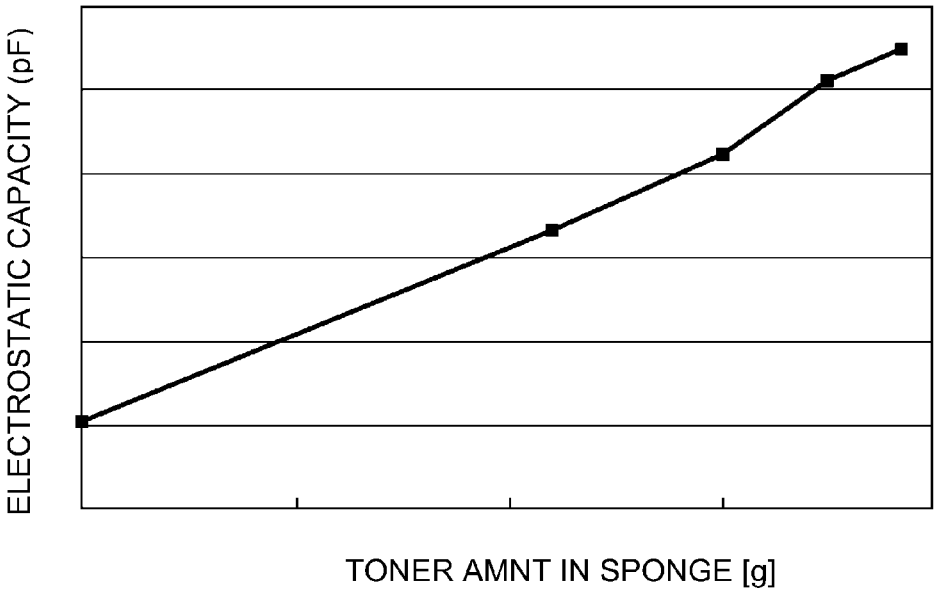
FIG. 3 is a graph showing a relation between an amount of the toner in the supplying roller and an electrostatic capacity.

FIG. 3 is a graph showing a relation between the toner amount in the supplying roller 24 and the electrostatic capacity. FIG. 3 shows the results of measurement of the relation between the toner the amount in the urethane sponge layer and the electrostatic capacity between the electroconductive core metal 25*a* of the developing roller 25 and the electroconductive core metal 24*a* of the supplying roller 24. The electrostatic capacity is measured by a LCR meter ZM2354 available from NF Corporation.

As shown in FIG. 3, the electrostatic capacity and the toner amount in urethane sponge layer of the supplying roller 24 are in a linear relation. From result, it is understood that there is a correlation between the toner amount held in the urethane sponge layer of the supplying roller 24 and the electrostatic capacity between the supplying roller 24 and the developing roller 25.

A physical situation and the correlation between the difference of the electrostatic capacity of the developing device and the non-uniform distribution of the toner in the container will be considered.

Figure 4:
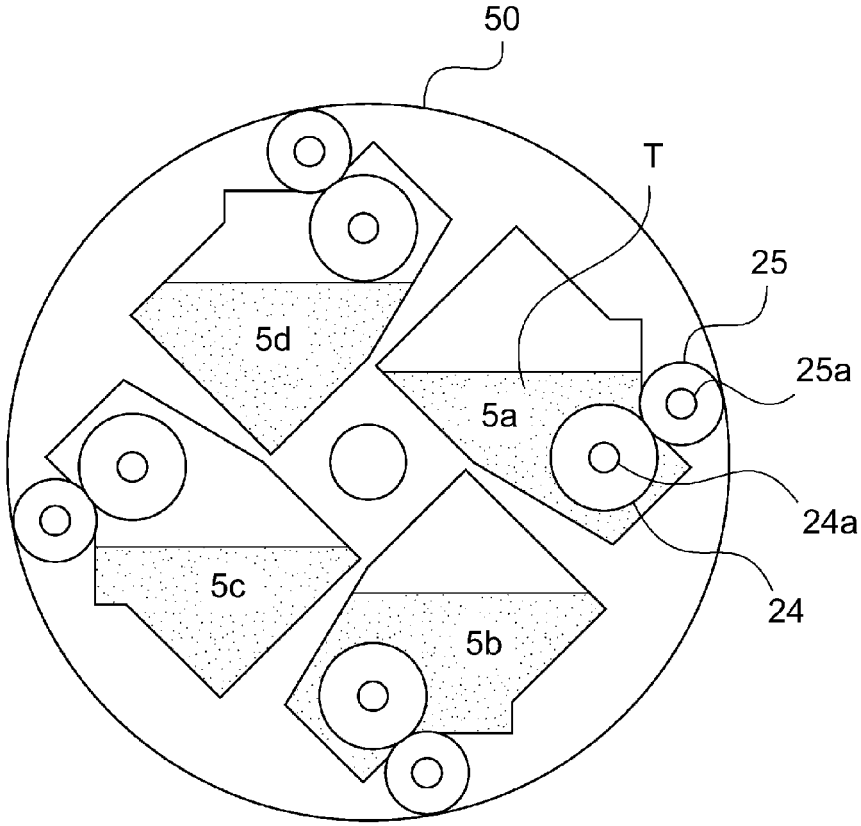
FIG. 4 is an illustration an attitude difference among the developing devices in this embodiment.

FIG. 4 illustrates an attitude difference of the developing device in this embodiment. FIG. 4 shows a state of the toner in the developing devices of the image forming apparatus when the longitudinal direction of the developing device (longitudinal direction of the supplying roller 24) is perpendicular to the direction of gravity, that is, a disposition attitude of the image forming apparatus.

In the state of FIG. 4, there are two states of the developing devices (5*a*, 5*b*, 5*c*, 5*d*), in one of which the urethane sponge layer of the supplying roller 24 is in the toner, and in the other of which it is out of the toner. More specifically, the urethane sponge layers of the supplying rollers 24 of the yellow developing device 5*a* and the magenta developing device 5*b* are in the toner over the entire zone in the longitudinal direction. On the other hand, the urethane sponge layers of the supplying roller 24 of the cyan developing device 5*c* and the black developing device 5*d* is not in the toner.

The plurality of developing devices 5 of this embodiment are supposed to be shipped in the state that they are mounted on the rotary drum 50. During the transportation of the image forming apparatus, a vibration in vertical direction may be imparted thereto, when traveling a bumpy road, for example. In such a case, too, the urethane sponge layers of the supplying roller 24 of the yellow developing device 5*a* and the magenta developing device 5*b* are in the toner over the entire zone. Therefore, the entire zones of the urethane sponge layers contain the toner.

On the other hand, the urethane sponge layers of the cyan developing device 5*c* and the black developing device 5*d* are not in the toner. In this case, the urethane sponge layers of the supplying rollers 24 do not contain the toner.

Figure 5:
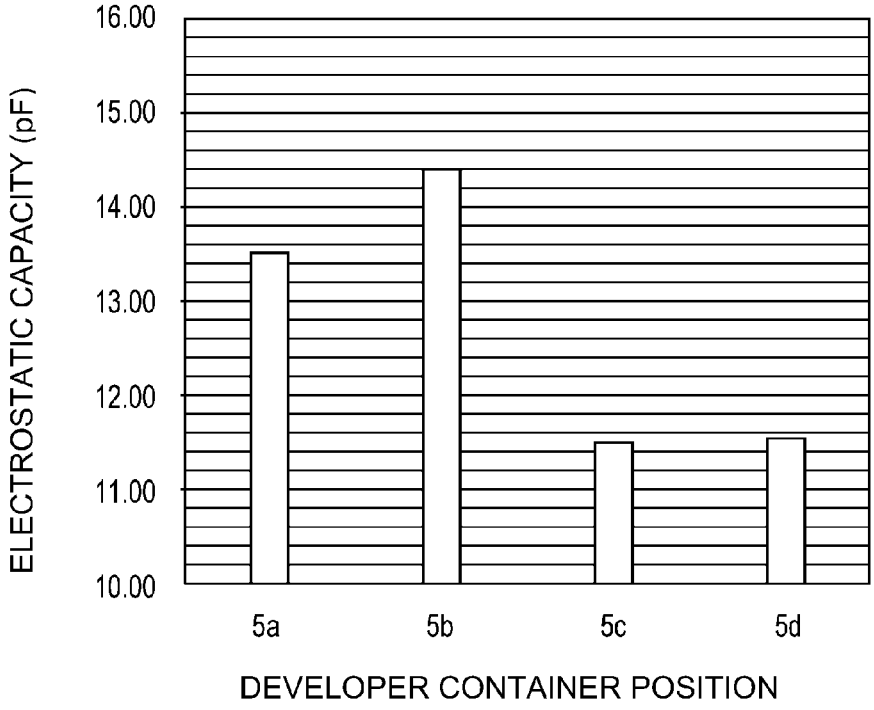
FIG. 5 shows electrostatic capacities when the toner distribution is uniform.
Figure 6:
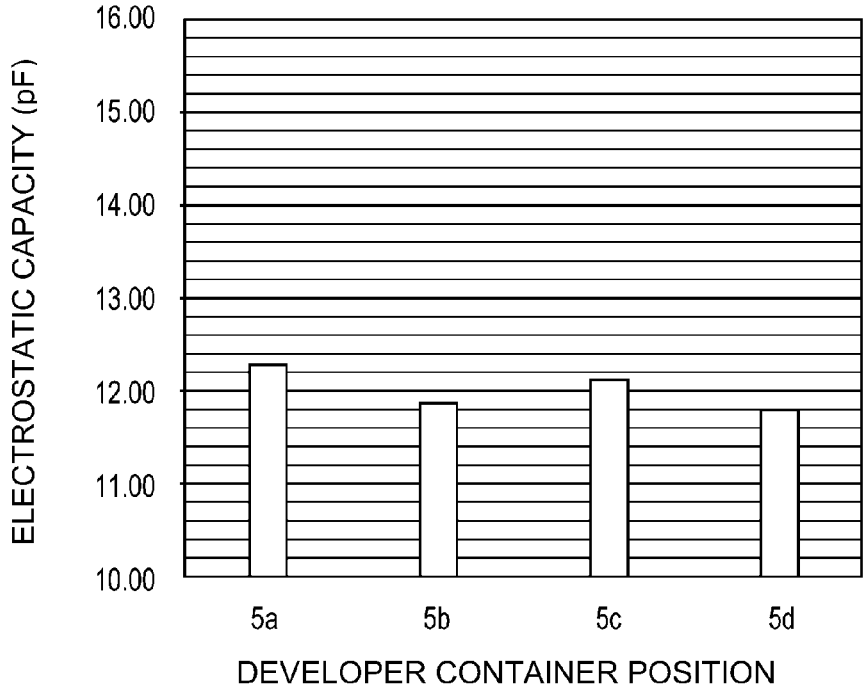
FIG. 6 shows electrostatic capacities when the toner distribution is non-uniform (offset).

Under such circumstances, there are two cases, in one of which the non-uniform distribution of the toner occurs, and the other of which the non-uniform distribution of the toner does not exists. FIG. 5 shows the electrostatic capacities of the developing devices when the non-uniform distribution of the toner does not exist. FIG. 6 shows the electrostatic capacities of the developing devices when the non-uniform distribution of the toner exists.

In the normal state, that is, when the non-uniform distribution of the toner does not exist, the electrostatic capacities (therefore the toner contents) of the yellow developing device 5*a* and the magenta developing device 5*b* are equivalent to those in the case that the urethane sponge layers of the supplying rollers 24 are in the toner. The electrostatic capacities in the cyan developing device 5*c* and the black developing device 5*d* are equivalent to those when the urethane sponge layers therein do not contain the toner.

On the other hand, the description will be made as to the case in which the image forming apparatus is placed vertically, that is, the longitudinal direction of the developing device is parallel with the direction of gravity. FIG. 6 shows the results of the measurement of the electrostatic capacities of the developing device under the states of the non-uniform distribution of the toner.

In this state, the longitudinal range in which the urethane sponge layers are in the toner are the same in the yellow developing device 5*a*, the magenta developing device 5*b*, the cyan developing device 5*c* and the black developing device 5*d*. If the vertical vibrations are imparted as when traveling the bumpy road, in such situation, the portions of the urethane sponge layers of the supplying rollers 24 of the yellow developing device 5*a*, the magenta developing device 5*b*, the cyan developing device 5*c* and the black developing device 5*d* which portions are in the respective toner powders, contain the toner powders. Then, the electrostatic capacities and therefore the toner content of the yellow developing device 5*a*, the magenta developing device 5*b*, the cyan developing device 5*c* and black developing device 5*d* are substantially all the same.

Thus, when the developing cartridges are vibrated in the normal attitude in the state that they are mounted to the image forming apparatus, a large difference appears in the electrostatic capacities of the developing devices 5, whereas when the vibration is imparted in the vertical attitude, the electrostatic capacities of the developing devices are substantially the same.

(Detecting Method for Non-Uniform Distribution of the Toner)

Figure 7:
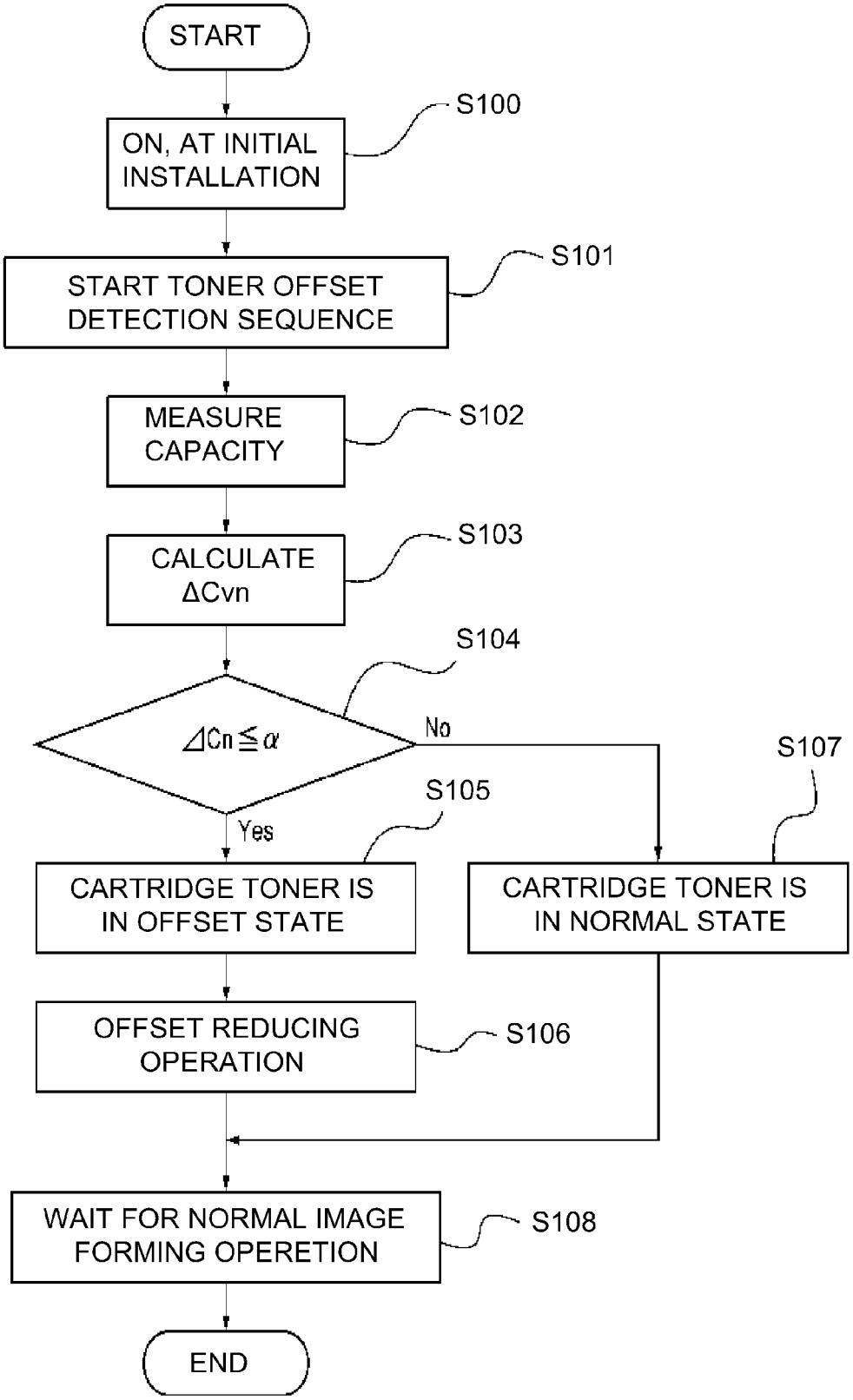
FIG. 7 is a flow chart of a detecting sequence for the non-uniform distribution (offset) of the toner in this embodiment.

The description will be made as to a detecting method for a non-uniform distribution of the toner in the developing device in this embodiment. FIG. 7 is a flow chart of the detecting sequence for the non-uniform distribution of the toner in this embodiment.

When the main switch is rendered on (S100) in the initial installation of the apparatus, the controller 36 starts the detecting sequence operation for the non-uniform distribution of the toner, without rotating the supplying roller 24 and the developing roller 25 (S101).

The reason for not rotating the supplying roller 24 and the developing roller 25 will be described. In this embodiment, the toner amounts contained in the supplying rollers 24 due to the vibrations are deduced on the basis of the electrostatic capacities. When the supplying roller 24 or the developing roller 25 are rotated, the toner contained in the supplying rollers 24 due to the vibrations or the like is supplied to the developing roller 25, and therefore, the possibility that the non-uniform distribution is not detected increases. For this reason, in this embodiment, the supplying roller 24 and the developing roller 25 are kept unrotated.

Then, electrostatic capacities Cva, Cvb, Cvc, Cvd of the developing devices 5 are measured (S102).

Here, the measurement attitude is as shown by the position E in FIG. 1. In the position E of FIG. 1, the toner neighborhood the supplying roller 24 falls by the gravity, and therefore, the influence of the toner density is less. Then, the output of the electrostatic capacity is stabilized.

Then, the absolute values of the differences among the detected electrostatic capacities Cva, Cvb, Cvc, Cvd are calculated. Here, $|Cva-Cvb|=\Delta Cv1$, $|Cva-Cvc|=\Delta Cv2$, $|Cva-Cvd|=\Delta Cv3$, $|Cvb-Cvc|=\Delta Cv4$, $|Cvb-Cvd|=\Delta Cv5$, and $|Cvc-Cvd|=\Delta Cv6$, (S103).

Then, it is checked whether or not the difference $\Delta Cvn$ (n=1-6) of the electrostatic capacities$\leq\alpha$ (S104). The threshold a can be selected easily by experiment. Specific examples will be described.

Figure 8:
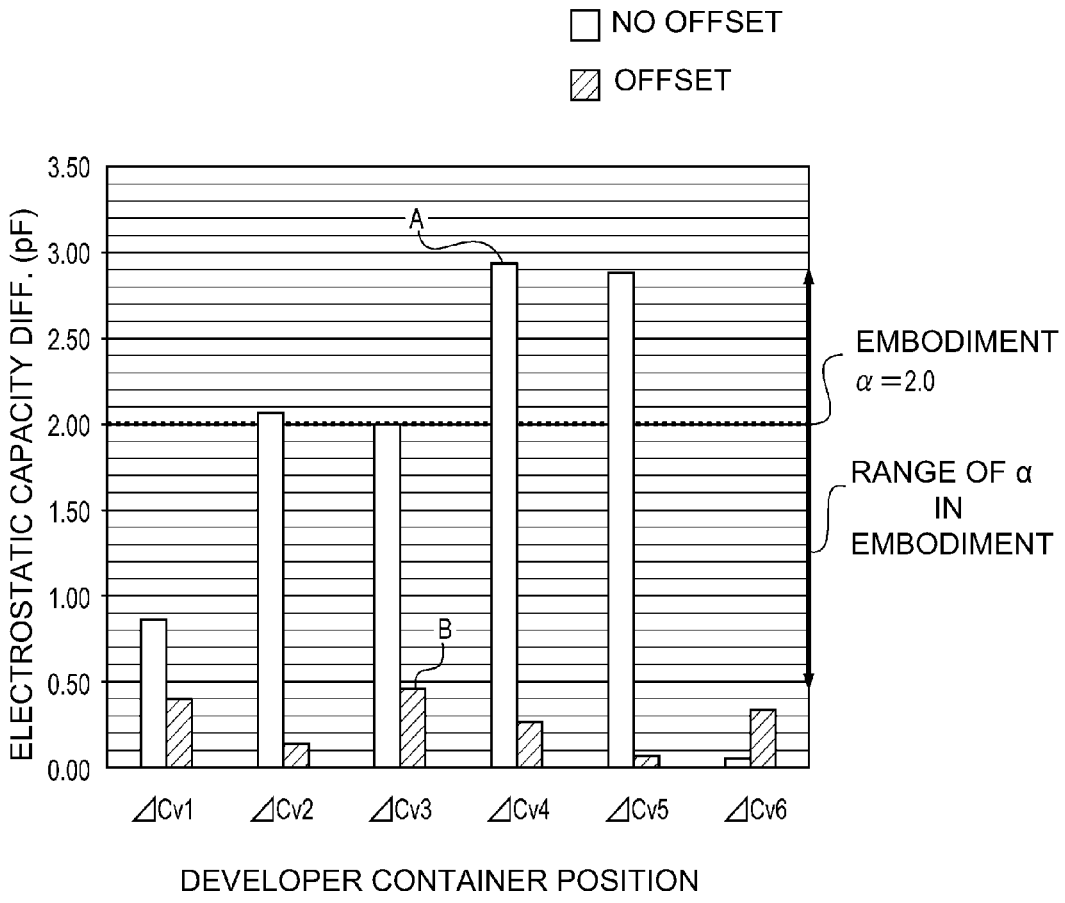
FIG. 8 shows an electrostatic capacity difference in the developing devices in this embodiment.

FIG. 8 shows the electrostatic capacity differences of the developing devices in this embodiment. In FIG. 8, the electrostatic capacity differences of the developing devices in the case that non-uniform distribution of the toner does not exist and in the case that the non-uniform distribution of the toner exist, in this embodiment. The condition of the threshold a in this embodiment will be described.

An upper limit of the threshold a can be determined as a difference between the electrostatic capacity when the urethane sponge layer is filled with the toner and that when the urethane sponge layer is free of the toner. In this embodiment, the difference is 2.9 pF (A in FIG. 8).

The lower limit of the threshold $\alpha$ is determined by a variation of the differences when the same amount of the toner is contained in the urethane sponge layer. The variation of the difference is 0.45 pF (B in FIG. 8) in this embodiment. With these conditions, the threshold $\alpha$=2.0 in this embodiment. The value of the threshold $\alpha$ is not limited to this.

Referring back to FIG. 7, the detection of the non-uniform distribution of the toner will be described. When difference $\Delta Cvn\leq\alpha$, the discriminating means 34 discriminates the occurrence of the non-uniform distribution of the toner (S105), and the controller 36 executes a reduction sequence operation for the non-uniform distribution of the toner (S106).

In the reduction sequence for non-uniform distribution of the toner, the rotary drum 50 carrying the developing devices 5 is rotated for a predetermined time period. By doing so, the toner distribution in the developing device 5 can be made more uniform with respect to the longitudinal direction.

In addition, when difference $\Delta Cvn\leq\alpha$, the occurrence of the non-uniform distribution of the toner discriminated at (S105) may be notified to the user by notification means.

When difference $\Delta Cvn>\alpha$, on the other hand, it is discriminated that the toner powder is in the normal state (S107), and the image can be formed through a normal sequential operation, and therefore, the apparatus is placed in the stand-by state (S108).

By carrying out the above-described said sequence process, the white void on one side of the image due to the non-uniform distribution of the toner in the initial installation of the apparatus can be avoided beforehand.

As described in the foregoing, the occurrence of the non-uniform distribution can be discriminated by the difference of the electrostatic capacity of the developing device 5 (5*a*, 5*b*, 5*c*, 5*d*), by which the toner non-uniform distribution can be reduced at the time of initial installation with a simple and assured structure.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 124318/2011 filed Jun. 2, 2011 which is hereby incorporated by reference.

What is claimed is:

1. An image forming apparatus comprising:

an image bearing member for carrying an electrostatic latent image;

a plurality of developing devices, each of which includes a developer carrying member, having an electrode member, for carrying a developer and for developing the electrostatic latent image, and a developer feeding member, having a core metal and a surface foam layer, for supplying the developer to said developer carrying member;

a supporting member, supporting said developing devices, for sequentially rotating said developing devices to a developing position where the electrostatic latent image is developed; and a controller for executing an operation for reducing non-uniform distributions of the developers in longitudinal directions of said developer feeding members in said developing devices on the basis of electrostatic capacities between said electrode members and said core metals in said developing devices, respectively.

2. An apparatus according to claim 1, wherein said controller executes the operation on the basis of a comparison of the electrostatic capacities between said electrode members and said core metals in said developing devices, respectively.

3. An apparatus according to claim 1, wherein said controller executes the operation which rotates said supporting member.

4. An apparatus according to claim 1, wherein said developing devices are shipped in a state of being supported by said supporting member.

5. An image forming apparatus comprising:

an image bearing member for carrying an electrostatic latent image;

a plurality of developing devices, each of which includes a developer carrying member, having an electrode member, for carrying a developer and for developing the electrostatic latent image, and a developer feeding member, having a core metal and a surface foam layer, for supplying the developer to said developer carrying member;

a supporting member, supporting said developing devices, for sequentially rotating said developing devices to a developing position where the electrostatic latent image is developed; and a controller for controlling a notification signal for notifying a user of non-uniform distributions of the developers in longitudinal directions of said developer feeding members in said developing devices on the basis of electrostatic capacities between said electrode members and said core metals in said developing devices, respectively.

6. An apparatus according to claim 5, wherein said controller controls the notification signal on the basis of a comparison of the electrostatic capacities between said electrode members and said core metals in said developing devices, respectively.

7. An apparatus according to claim 5, wherein said developing devices are shipped in a state of being supported by said supporting member.

8. An image forming apparatus comprising:

an image bearing member for carrying an electrostatic latent image;

a plurality of developing devices, each of which includes a developer carrying member, having an electrode member, for carrying a developer and for developing the electrostatic latent image, and a developer feeding member, having a core metal and a surface foam layer, for supplying the developer to said developer carrying member;

a supporting member, supporting said developing devices, for sequentially rotating said developing devices to a developing position where the electrostatic latent image is developed; and a detector for detecting non-uniform distributions of the developers in longitudinal directions of said developer feeding members in said developing devices on the basis of electrostatic capacities between said electrode members and said core metals in said developing devices, respectively.

9. An apparatus according to claim 8, wherein said detector detects the non-uniform distribution on the basis of a comparison of the electrostatic capacities between said electrode members and said core metals in said developing devices, respectively.

10. An apparatus according to claim 8, wherein said developing devices are shipped in a state of being supported by said supporting member.

* * * * *